United States Patent [19]

Anderson, II et al.

[11] Patent Number: 4,866,423

[45] Date of Patent: Sep. 12, 1989

[54] OVERHEAD SPRINKLER HEAD PROXIMITY ALARM

[75] Inventors: Howard B. Anderson, II, Santa Clara; Stephen D. Marks, San Jose; Randall W. Cook, Palo Alto, all of Calif.

[73] Assignee: Tandy Corporation, Fort Worth, Tex.

[21] Appl. No.: 189,905

[22] Filed: May 3, 1988

[51] Int. Cl.[4] ..... G08B 13/00; H01H 3/16

[52] U.S. Cl. ..... 340/541; 200/61.41

[58] Field of Search ..... 340/541, 686, 51, 61; 200/61.41, 61.93; 169/23, 37; 180/274

[56] References Cited

U.S. PATENT DOCUMENTS

| | | | |
|---|---|---|---|
| 3,797,746 | 3/1974 | Gray et al. | 169/37 X |
| 4,288,777 | 9/1981 | Luik | 340/51 |
| 4,311,983 | 1/1982 | Piper | 340/51 |
| 4,341,488 | 7/1982 | Ryan | 340/51 X |
| 4,660,648 | 4/1987 | Zen | 169/37 X |
| 4,734,549 | 3/1988 | Naoi et al. | 200/61.41 |

OTHER PUBLICATIONS

Grinnell Sprinkler Guards Models F774 8, F776, dated Sep. 1984.

*Primary Examiner*—Glen R. Swann, III
*Assistant Examiner*—Thomas J. Mullen, Jr.
*Attorney, Agent, or Firm*—Townsend and Townsend

[57] ABSTRACT

A proximity alarm (2) is used to protect overhead sprinkler heads (4) from damage by signaling when an object, typically carried by a forklift, comes too close to the sprinkler head. The alarm includes a signal circuit (24) mounted within a housing (22), a mounting clamp (10) and an arm (20) connecting the mounting clamp and the housing. The clamp secures the alarm to the sprinkler head adjacent the downwardly extending water pipe (8). The signal circuit includes a signal element (30), such as a horn, and a switch (26) for actuating the signal element. The switch is operated by a trigger (32) which extends downwardly from the housing. The trigger includes a portion (38, 44) positioned to contact an object coming close to the sprinkler head. Thus, when a forklift driver is lifting an object and the object contacts the trigger, the trigger actuates the switch causing the signal element to provide a signal, typically an audible alarm, warning the operator to halt movement of the load.

13 Claims, 2 Drawing Sheets

OVERHEAD SPRINKLER HEAD PROXIMITY ALARM

BACKGROUND OF THE INVENTION

Sprinkler systems are a widely used and effective means for protecting people and property from fire damage. In structures such as office buildings and hotels the sprinkler heads are often semi-recessed into the ceiling, generally out of sight and out of harm's way. However, the same sprinkler heads in a warehouse environment are often somewhat exposed and subject to damage. This is particularly so when forklifts and other similar apparatus are used to move objects around and lift them to heights approaching the sprinkler heads. Because of this, sprinkler heads are often bumped by objects being carried by forklifts causing the sprinkler head to be seriously damaged or even broken away from the water pipe. The common result is a rush of water from the broken sprinkler head which not only disrupts operations but also often causes extensive damage to the products and material in the area.

Recognizing this, cages are often used around the sprinkler head. However, although the cage may protect the sprinkler head from minor jarring, the cages are woefully inadequate to protect against sprinkler head damage when loads are being moved about by mechanical means, such as forklifts. Not only are the forces exerted against the cage and sprinkler head sufficient to break the entire sprinkler head off of the water pipe, the cages tend to bend under impact sufficiently so that the bent cages themselves end up damaging the sprinkler heads.

SUMMARY OF THE INVENTION

The present invention provides a simple, relatively inexpensive method for protecting overhead sprinkler heads from damage by providing an alarm signal, typically an audible signal or both audible and visual signals, indicating that an object is close to the sprinkler head so that an operator can prevent the object from hitting the sprinkler head.

The overhead sprinkler head alarm includes broadly a frame having a mounting element for mounting the frame near the sprinkler head. Typically the mounting element is in the form of a clamp, used to simply but effectively mount the frame to the sprinkler head adjacent the lower end of the water pipe to which the sprinkler head is mounted. The alarm also includes a signal circuit having a signal element and a switch so that when the switch is operated, the signal element is actuated. The alarm further includes some sort of trigger, coupled to the switch, for operating the switch when an object is close to the sprinkler head. Preferably the trigger is a mechanical trigger which has a portion which is positioned at an elevation vertically below the sprinkler head, but not necessarily directly beneath the sprinkler head. Alternatively, a proximity sensor could be used as the trigger to sense when an object is getting close to the sprinkler head and thus operate the switch. Although the signal circuit is preferably electric, it could be entirely mechanical as well.

The frame preferably includes a housing containing the signal circuit and a horizontal support arm connecting the housing to the clamp.

One of the primary advantages of the invention is that it is relatively simple and inexpensive to make and install. Installation requires no modifications to an existing sprinkler system and does not affect the operation of the sprinkler system. The invention provides a simple but cost effective way to protect overhead sprinkler heads from damage to substantially eliminate the costs associated with damaged sprinkler heads.

Other features and advantages of the invention will appear from the following description in which the preferred embodiment has been set forth in detail in conjunction with the accompanying drawings.

DETAILED DESCRIPTION OF THE PREFERRED EMBODIMENT

Figure 1:
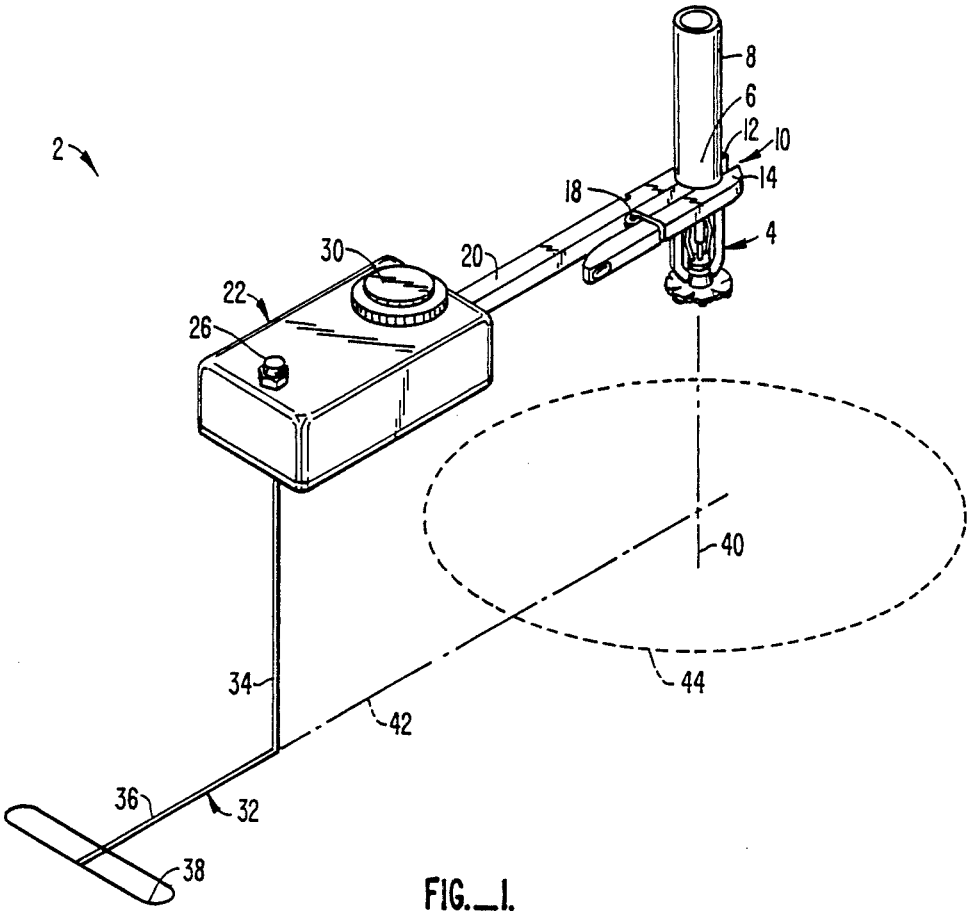
FIG. 1 is a perspective view showing an overhead sprinkler head alarm in use, with an alternative shape of the trigger being shown in dashed lines.
Figure 2:
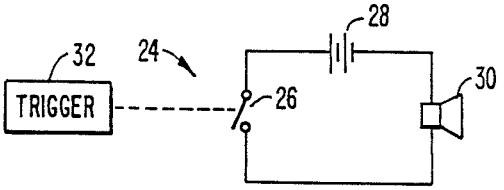
FIG. 2 is a schematic representation of the signal circuit and trigger of FIG. 1.
Figure 3:
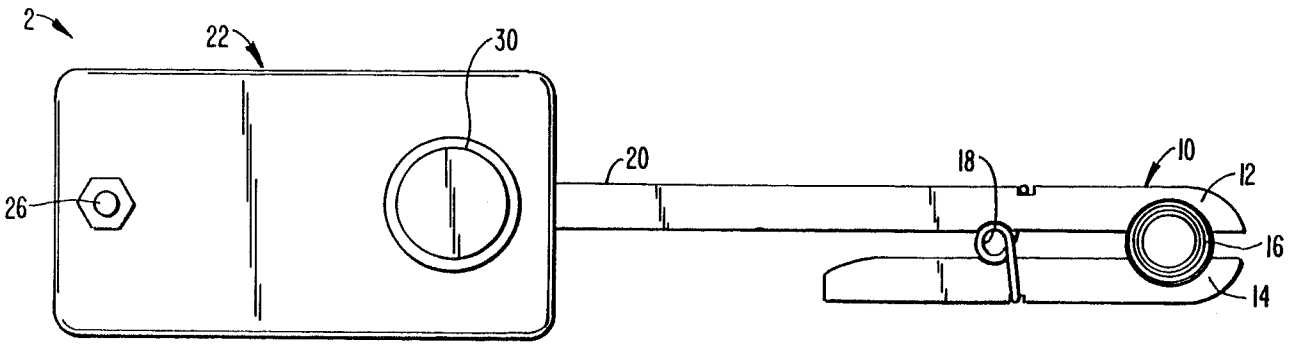
FIG. 3 is a top plan view of the alarm of FIG. 1.
Figure 4:
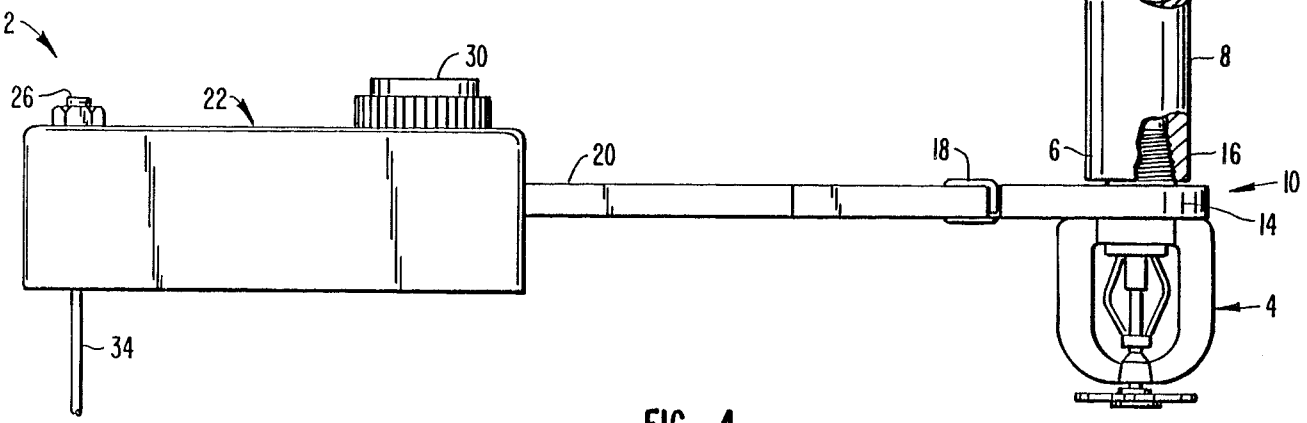
FIG. 4 is a side elevational view of the alarm, water pipe and sprinkler head of FIG. 1.

Turning now to FIGS. 1 and 2, an overhead sprinkler head alarm 2 is shown mounted to a sprinkler head 4 adjacent the lower end 6 of a water pipe 8. Alarm 2 includes a clamp 10 having a pair of jaws 12, 14 which resiliently engage an externally threaded end 16 of sprinkler head 4 through the biasing force of a torsion spring 18. Jaw 12 includes an extension 20 which acts as a horizontal support arm connecting clamp 10 to a housing 22. Housing 22 contains a signal circuit 24. Signal circuit 24 includes a switch 26, a battery 28 and a horn 30, acting as the signal element, all in series. Switch 26 is physically connected to a trigger 32 which consists of a shaped rod or piece of stiff wire. Trigger 32 is constructed with a downwardly extending rod portion 34, a first horizontal portion 36 and a second, looped horizontal portion 38. Trigger 32 and switch 26 are constructed so that when an object contacts trigger 32, trigger 32 moves to actuate switch 26.

In the preferred embodiment trigger 32 extends vertically below but laterally to one side of a vertical centerline 40 passing through sprinkler head 4. If desired trigger 32 could be configured as illustrated by the dash lines in FIG. 1 with a straight horizontal portion 42 and a circular horizontal portion 44, portion 44 being positioned vertically below sprinkler head 4 and concentric with vertical centerline 40. Switch 26, in the preferred embodiment, is a normally open bi-directional switch sensitive to movement of trigger 32 in a direction generally parallel to portions 36, 42 of the trigger. It has been found that contact with trigger 32 in the disclosed configurations provides sufficient movement of downwardly extending rod 34 in the vertical plane passing through portions 36, 42 that an omni-directional switch may not be necessary. However, if desired switch 26 could be an omni-directional switch. Switch 26 could be sensitive to force applied to trigger 32 rather than movement.

Trigger 32 and switch 26 could be designed as a proximity sensor arrangement in which no physical contact is needed. Rather, a proximity sensor, operably coupled to switch 26, could be used as trigger 32 to sense when a foreign object comes close to sprinkler head 4. In such a case housing 22 would likely be mounted much closer to sprinkler head than the embodiment of FIG. 1.

In use, the user provides protection for sprinkler head 4 by simply opening jaws 12, 14, placing jaws 12, 14 over threaded end 16 of sprinkler head 4, and releasing the jaws so to support alarm 2 from the sprinkler head. If while lifting an object, for example using a forklift, the object contacts trigger 32 and moves the trigger so to close switch 26, signal element 30 is actuated sounding an audible alarm. The size and configuration of trigger 32 is such to give the operator sufficient time to halt movement of the object and thus protect sprinkler head 4 from impact by the object. Testing alarm 2 is simple, one need merely move trigger 32 to see if the alarm works. In the preferred embodiment a battery 28 is used. If desired a low battery warning circuit, such as are used with battery powered smoke alarms, could be incorporated into signal circuit 24 to indicate when battery 28 should be replaced.

Modification and variation can be made to the disclosed embodiment without departing from the subject of the invention as defined in the following claims. For example, in the preferred embodiment clamp 10 is configured to mount to end 16 of sprinkler head 4. Clamp 10 could also be configured to mount to water pipe 8 or both end 16 and water pipe 8. In some cases alarm 2 could be mounted to support structures other than sprinkler head 4 or water pipe 8, which may require a redesign of clamp 10.

What is claimed is:

1. An overhead sprinkler head alarm, for protecting an overhead sprinkler head from mechanical damage, comprising:

a frame including a mounting element for removably mounting the frame to a support near the sprinkler head;

a signal circuit mounted to the frame including a signal element and a switch which, when operated, causes the signal element to be actuated; and trigger means, coupled to the switch, for operating the switch when an object is within a chosen region associated with the sprinkler head so as to actuate the signal element to alert a user that the object is within the chosen region;

said trigger means and switch operable without physical contact with the object, providing the object is within the chosen region.

2. The alarm of claim 1 wherein the support includes an element associated with the sprinkler head and the mounting element includes a clamp configured for clamping onto said associated element so the associated element supports the alarm.

3. A proximity alarm for signaling a worker that an object the worker is moving is too close to an overhead sprinkler head so the user can do something to keep the object from hitting the sprinkler head so to prevent damage to the sprinkler head, the sprinkler head being mounted to a water pipe, the alarm comprising:

a housing;

a clamp connected to the housing and configured for engaging at least the water pipe or the sprinkler head, the clamp engaging a chosen one of the water pipe and the sprinkler head so to support the housing and support arm therefrom;

an alarm circuit mounted to the housing, the alarm circuit including a signal element and a switch which when operated completes the alarm circuit to actuate the signal element and alert the worker; and a trigger mounted to and extending from the switch, the trigger including a portion positioned near but vertically below the sprinkler head so that when the object contacts the trigger in a manner to operate the switch, the signal element is actuated thereby alerting the worker that the object is close to the sprinkler head.

4. An overhead sprinkler head alarm, for protecting an overhead sprinkler head from mechanical damage, comprising:

a frame including a clamp configured for removably mounting the frame to an element associated with and near the sprinkler head, said clamp configured for clamping onto said associated element so the associated element supports the alarm;

a signal circuit mounted to the frame including a signal element and a switch which, when operated, causes the signal element to be actuated; and trigger means, coupled to the switch, for operating the switch when an object is within a chosen region associated with the sprinkler head so as to actuate the signal element to alert a user that the object is within the chosen region.

5. The alarm of claim 4 wherein the trigger means include a mechanical trigger extending from the switch, a portion of the trigger extending vertically below the sprinkler head so that a vertically moving load will contact the trigger portion to operate the switch and actuate the signal element thereby alerting a user that the load is close to the sprinkler head.

6. The alarm of claim 5 wherein the trigger includes a vertically downwardly extending rod.

7. The alarm of claim 6 wherein the rod is straight.

8. The alarm of claim 5 wherein the switch is a multidirectional switch and is operated by moving the trigger in a plurality of directions.

9. The alarm of claim 4 wherein the frame includes a signal circuit housing and the mounting element includes a horizontally extending arm connecting the clamp and the signal circuit housing.

10. The alarm of claim 4 wherein the associated element is a part of the sprinkler head.

11. The alarm of claim 4 wherein the signal element includes an audible signal element.

12. An overhead sprinkler head alarm, for protecting an overhead sprinkler head from mechanical damage, comprising:

a frame including a mounting element for removably mounting the frame to a support near the sprinkler head;

a signal circuit mounted to the frame including a signal element and a switch which, when operated, causes the signal element to be actuated; and a mechanical trigger extending from the switch and coupled thereto, a portion of the trigger extending vertically below and positioned to one side of the sprinkler head so that a vertically moving load moving within a chosen region associated with the sprinkler head will contact the trigger portion to operate the switch and actuate the signal element, thereby alerting a user that the load is close to the sprinkler head.

13. An overhead sprinkler head alarm, for protecting an overhead sprinkler head from mechanical damage, comprising:

a frame including a mounting element for removably mounting the frame to a support near the sprinkler head;

a signal circuit mounted to the frame including a signal element and a switch which, when operated, causes the signal element to be actuated; and a mechanical trigger extending from the switch and coupled thereto, a portion of the trigger extending vertically below the sprinkler head and circumscribing a vertical centerline passing through the sprinkler head such that a vertically moving load moving within a chosen region associated with the sprinkler head will contact the trigger portion to operate the switch and actuate the signal element, thereby alerting a user that the load is close to the sprinkler head.

* * * * *